US009119257B2

(12) United States Patent
Yang

(10) Patent No.: US 9,119,257 B2
(45) Date of Patent: Aug. 25, 2015

(54) DIMMING DEVICE AND DIMMING METHOD THEREOF

(71) Applicant: INNOLUX CORPORATION, Miao-Li County (TW)

(72) Inventor: Cheng-Feng Yang, Miao-Li County (TW)

(73) Assignee: INNOLUX CORPORATION, Miaoli County (TW)

( * ) Notice: Subject to any disclaimer, the term of this patent is extended or adjusted under 35 U.S.C. 154(b) by 215 days.

(21) Appl. No.: 13/944,935

(22) Filed: Jul. 18, 2013

(65) Prior Publication Data

US 2014/0042919 A1 Feb. 13, 2014

(30) Foreign Application Priority Data

Aug. 8, 2012 (TW) ..... 101128629 A

(51) Int. Cl.
*H05B 41/16* (2006.01)
*H05B 41/24* (2006.01)
*H05B 33/08* (2006.01)

(52) U.S. Cl.
CPC ..... *H05B 33/0839* (2013.01); *H05B 33/0815* (2013.01); *H05B 33/0827* (2013.01)

(58) Field of Classification Search
USPC ..... 315/129–136
See application file for complete search history.

(56) References Cited

U.S. PATENT DOCUMENTS

2006/0001381 A1* 1/2006 Robinson et al. ..... 315/185 R
2009/0267530 A1 10/2009 Yang et al.
2010/0013412 A1* 1/2010 Archibald et al. ..... 315/294
2010/0327772 A1* 12/2010 Lee et al. ..... 315/297
2011/0062887 A1* 3/2011 Hsu et al. ..... 315/294
2011/0109238 A1* 5/2011 Tang et al. ..... 315/250
2011/0109247 A1* 5/2011 Hoogzaad et al. ..... 315/294
2011/0267375 A1* 11/2011 Yang et al. ..... 345/690
2012/0139434 A1 6/2012 Hsu et al.
2012/0286677 A1 11/2012 Hsu et al.
2013/0169173 A1* 7/2013 Chen et al. ..... 315/186

FOREIGN PATENT DOCUMENTS

CN 101902861 A 12/2010
TW 200945291 11/2009
TW 201112868 A1 4/2011
TW 201117666 A1 5/2011

OTHER PUBLICATIONS

Taiwan Patent Office, Office action issued on Jul. 22, 2014.
China Patent Office, Office action issued on Feb. 28, 2015.

* cited by examiner

*Primary Examiner* — Brandon S Cole
(74) *Attorney, Agent, or Firm* — Li&Cai Intellectual Property (USA) Office

(57) ABSTRACT

A dimming method is provided. The dimming method includes steps as follows: determining whether a duty ratio of a first pulse width modulation signal is larger than a threshold duty ratio; when the duty ratio of the first PWM signal is smaller than the threshold duty ratio, the first pulse width modulation signal is transformed to a second pulse width modulation signal by a frequency conversion and a phase shift according to a pulse information signal, when the duty ratio of the first pulse width modulation signal is larger than the threshold duty ratio, adjusting a predetermined dimming current according to the pulse information signal, wherein the threshold duty ratio is set according to a number of the channel and the predetermined dimming current.

16 Claims, 4 Drawing Sheets

DIMMING DEVICE AND DIMMING METHOD THEREOF

BACKGROUND OF THE INVENTION

1. Field of the Invention

The instant disclosure relates to a dimming method; in particular, a dimming method operated in a composite way.

2. Description of Related Art

In recent years, many electronic products are equipped with display screens; these electronic products are such as mobile phones, personal digital assistants machines (Personal Digital Assistant, PDA), digital music players and car dashboards. Although types and sizes of the screens are usually determined according to their applications, design engineers still have to design lighting circuits. Most displays, including thin film transistor liquid crystal displays, are in need of backlighting so that users are able to see graphics and texts on the screens. A light-emitting diode backlight module is often used in the electronic products. To achieve a uniform backlighting, a color liquid crystal display screen needs three to four or more light emitting diodes, and a backlight of the dashboard may require six or even more light emitting diodes. Due to an increase of demand for the light-emitting diodes, a strong impetus of growth of the market for light-emitting diodes is developed.

However, there is an acoustic noise easily generated by back-light modules with organic light-emitting diodes as a light resource. With more opportunities for portable electronic devices, such as the mobile phones, to get close to ears of the users; the users are under more chances of disturbances caused by the acoustic noise. Based on the related art, problems caused by the acoustic noise require an individual adjustment or modification, consuming a great amount of labor, time, and money.

SUMMARY OF THE INVENTION

The instant disclosure provides a dimming circuit, and is used to drive a light-emitting diode unit. The dimming circuit includes a control unit, a sampling analysis unit, a pulse width signal adjusting unit, and an analog dimming circuit. The control unit determines whether a duty ratio of a first pulse width modulation signal is larger than a threshold duty ratio. The sampling analysis unit receives and analyzes the first pulse width modulation signal and outputs a pulse information signal. The pulse width signal adjusting unit is coupled between the control unit and a current regulation unit to receive the pulse information signal. The analog dimming circuit is coupled between the control unit and the current regulation unit to receive the pulse information signal.

When the duty ratio of the first pulse width modulation signal is smaller than the threshold duty ratio, the pulse width signal adjusting unit transforms the first pulse width modulation signal to a second pulse width modulation signal by a frequency conversion and a phase shift according to the pulse information signal, and the analog dimming circuit outputs a predetermined dimming current.

When the duty ratio of the first pulse width modulation signal is larger than the threshold duty ratio, the analog dimming circuit adjusts the predetermined dimming current according to the pulse information signal, and the pulse width signal adjusting unit outputs a second pulse width modulation signal with a 100% duty ratio.

In the embodiment of the instant disclosure, a dimming method for a light-emitting diode is also provided. The method including steps as follows: determining whether the duty ratio of the first pulse width modulation signal is larger than the threshold duty ratio; when the duty ratio of the first pulse width modulation signal is smaller than the threshold duty ratio, transforming the first pulse width modulation signal to the second pulse width modulation signal by frequency conversion and a phase shift according to the pulse information signal, and outputting the predetermined dimming current; when the duty ratio of the first pulse width modulation signal is larger than the threshold duty ratio, adjusting the predetermined dimming current according to the pulse information signal.

Based on the above, the embodiment of the instant disclosure provides the dimming circuit and the dimming method thereof, according to a comparison between the duty ratio of the first pulse width modulation signal and the threshold duty ratio to determine which dimming measure to be adopted, and thus the acoustic noise generated by a back-light module is reduced.

For further understanding of the instant disclosure, reference is made to the following detailed description illustrating the embodiments and examples of the instant disclosure. The description is only for illustrating the instant disclosure, not for limiting the scope of the claim.

BRIEF DESCRIPTION OF THE DRAWINGS

The paragraphs above refer to accompanying drawings for describing the embodiment of the instant disclosure in detail and for better comprehension of the instant disclosure. The drawings are as follows.

DETAILED DESCRIPTION OF PREFERRED EMBODIMENTS

Figure 1:
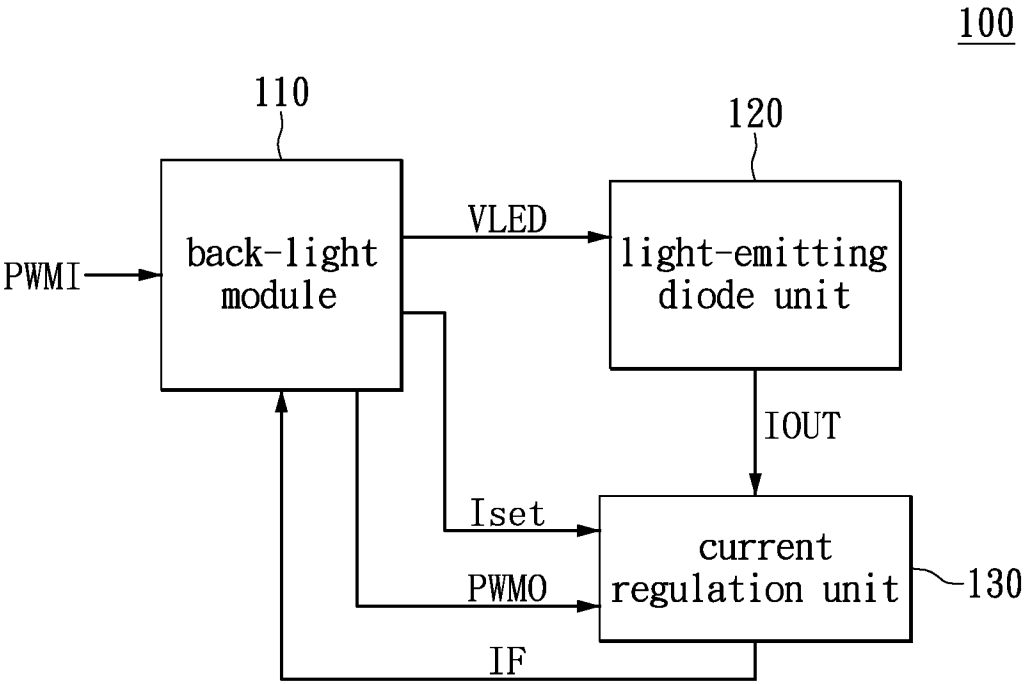
FIG. 1 shows a schematic diagram of a back-light module according to an embodiment of the instant disclosure.

The aforementioned illustrations and following detailed descriptions are exemplary for the purpose of further explaining the scope of the instant disclosure. Other objectives and advantages related to the instant disclosure will be illustrated in the subsequent descriptions and appended drawings. In the drawings, the size and relative sizes of layers and regions may be exaggerated for clarity.

It will be understood that, although the terms first, second, third, and the like, may be used herein to describe various elements, components, regions, layers and/or sections, these elements, components, regions, layers and/or sections should not be limited by these terms. These terms are only to distinguish one element, component, region, layer or section from another region, layer or section discussed below could be termed a second element, component, region, layer or section without departing from the teachings of the instant disclosure. As used herein, the term "and/or" includes any and all combinations of one or more of the associated listed items.

[Embodiment of a Back-Light Module]

Referring to FIG. 1, FIG. 1 shows a schematic diagram of a back-light module according to an embodiment of the instant disclosure. The back-light module 100 includes a dimming circuit 110, a light-emitting diode unit 120, and a current regulation unit 130. The dimming circuit 110 is coupled to the light-emitting diode unit 120. The current regulation unit 130 is coupled between the light-emitting diode unit 120 and the dimming circuit 110. The back-light module 100 may be the back-light module used in a general flat panel display, such as an organic light-emitting diode display, or the back-light module used in a portable electronic device, such as a mobile phone; however, it is not limited hereto.

The dimming circuit 110 receives a first pulse width modulation signal PWMI to determine whether a duty ratio of the PWMI is larger than a threshold duty ratio, and the dimming circuit 110 transforms the first pulse width modulation signal PWMI to a second pulse width modulation signal PWMO by a frequency conversion and a phase shift according to a pulse information signal, or adjusts a predetermined dimming current Iset according to the pulse information signal.

The current regulation unit 130 is used for receiving the second pulse width modulation signal PWMO or the predetermined dimming current Iset to adjust an output current IOUT of the light-emitting diode unit 120. More details of relevant operation of the back-light module 100 are recited in the following descriptions.

In the present embodiment, the dimming circuit 110 of the back-light module 100 outputs a driving voltage VLED to drive the light-emitting diode unit 120, and in a process of driving the light-emitting diode unit 120, the dimming circuit 110 receiving a feedback current IF outputted by the regulation unit 130 to adjust the driving voltage VLED, and then the light-emitting diode unit 120 is driven thereby. In the meantime, the dimming circuit 110 receives first pulse width modulation signal PWMI, and then takes samples of first pulse width modulation signal PWMI to analyze, and to obtain signal information, such as a duty ratio and a frequency, of the first pulse width modulation signal PWMI. Afterwards, the dimming circuit 110 operates a calculating comparison between the duty ratio of the first pulse width modulation signal PWMI and the threshold duty ratio, and a comparing result is used in determining which of following dimming methods to be adopted for the light-emitting diode unit 120, and to reduce the acoustic noise generated by the back-light module 100.

When the duty ratio of the first pulse width modulation signal PWMI is smaller than the threshold duty ratio, the dimming circuit 110 transforms the first pulse width modulation signal PWMI to the second pulse width modulation signal PWMO by frequency conversion and a phase shift; moreover, the dimming circuit 110 outputs a various second pulse width modulation signal PWMO according to a different duty ratio and frequency of the first pulse width modulation signal PWMI. Then, the dimming circuit 110 transmits the second pulse width modulation signal PWMO and the predetermined dimming current Iset to the current regulation unit 130 for further adjusting the output current IOUT of the light-emitting diode unit 120.

The threshold duty ratio recited above may be set based on the predetermined dimming current Iset; for example, the predetermined dimming current Iset is divided by a rated current of the light-emitting diode, such as 20 milliampere, to obtain a current ratio, and then the threshold duty ratio is a result of the current ratio multiplied by 100%. In addition, the rated current of the light-emitting diode is a highest current of a unit (the light-emitting diode) being measured after a manufacture, wherein the current is able to supply for an operation. In an alternate preferred embodiment, the predetermined dimming current Iset may be set as a highest light conversion efficiency of the light-emitting diode, such as 5 milliampere, and thus when the light-emitting diode unit 120 is driven under a condition of the duty ratio of the first pulse width modulation signal PWMI is smaller than the threshold duty ratio, a better driven efficiency is achieved. The highest light conversion efficiency of the light-emitting diode may be determined by a statistics result after a measurement is performed. In another alternate embodiment, the threshold duty ratio may be further determined according to a number of channel inside of the light-emitting diode unit 120; for instance, the threshold duty ratio may be the current ratio multiplied by 100% and then be divided by the number of channel inside of the light-emitting diode unit 120, and thereby to assure that signals of the second pulse width modulation signal PWMO do not overlap after the phase shift. In other embodiments, in addition to the number of channel inside of the light-emitting diode unit is used to determine the threshold duty ratio, the threshold duty ratio may also be alternated by a random number according to a product demand.

On the other hand, when the duty ratio of the first pulse width modulation signal PWMI is larger than the threshold duty ratio, the dimming circuit 110 outputs a second pulse width modulation signal PWMO with a 100% duty ratio to the current regulation unit 130. That is, the dimming circuit 110 outputs a direct current (DC) voltage to the current regulation unit 130. In the meantime, the dimming circuit 110 adjusts the predetermined dimming current Iset, and transmits the adjusted predetermined dimming current Iset to the current regulation unit 130, and further adjusts the output current IOUT of the light-emitting diode unit 120. In addition, when the duty ratio of the first pulse width modulation signal PWMI is equal to the threshold duty ratio, a designer may accord to the demand of a circuit design to define the situation as to adopt the dimming mechanism for the duty ratio of the first pulse width modulation signal PWMI larger than the threshold duty ratio, or to adopt the dimming mechanism for the duty ratio of the first pulse width modulation signal PWMI smaller than the threshold duty ratio. Based on the above descriptions, the back-light module 100 is able to use a composite dimming method of the dimming circuit 110 to reduce the acoustic noise generated inside of the back-light module 100, or even to completely clear the acoustic noise under an ideal condition.

It is worth mentioning that the dimming method of the dimming circuit 110 in the present embodiment may be applied to panels of various frequencies; that is, the dimming circuit 110 of the instant disclosure offers a composite dimming mechanism for all kinds of panels.

To describe an operation process of the dimming circuit 110 of the instant disclosure in detail, there is at least one of embodiments in the following paragraphs for further instruction.

In the following embodiments, there are only parts which are different from the parts of the first embodiment will be described, and omitted parts are identical to the parts in the first embodiment. Moreover, please refer to similar units for similar referred numbers or labels.

[Embodiment of a Dimming Circuit]

Figure 2:
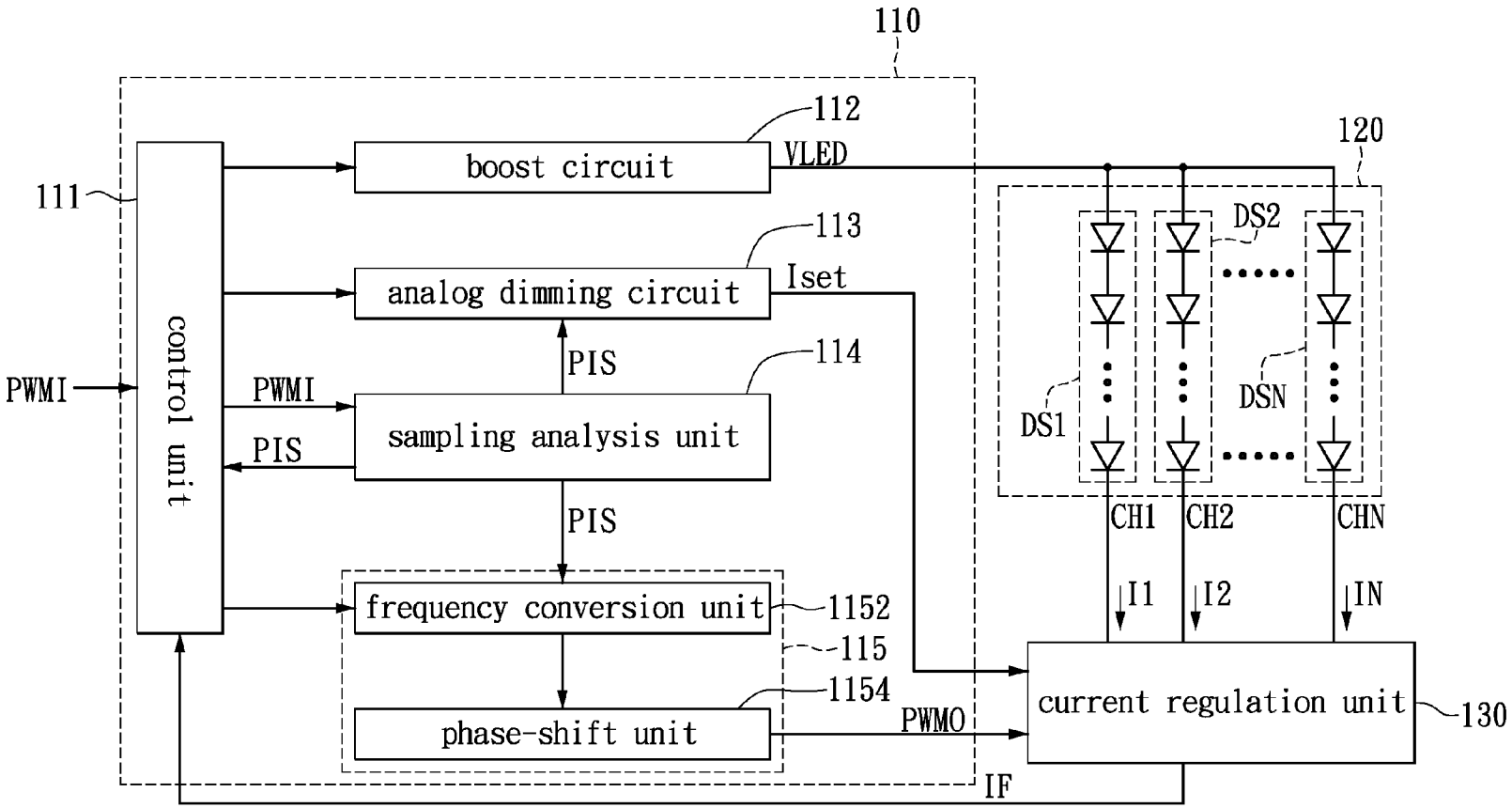
FIG. 2 shows a detailed schematic diagram of a dimming circuit according to the embodiment of the instant disclosure.

Referring to FIG. 2, FIG. 2 shows a detailed schematic diagram of a dimming circuit according to the embodiment of the instant disclosure. Different from the first embodiment, a dimming circuit 110 includes a control unit 111, a boost circuit 112, an analog dimming circuit 113, a sampling analysis unit 114 and a pulse width signal adjusting unit 115. The pulse width signal adjusting unit includes a frequency conversion unit 1152 and a phase-shift unit 1154. A light-emitting diode unit 120 includes at least a light-emitting diode string, and there are N sets of light-emitting diode strings DS1~DSN for a use of instruction in the following embodiment, wherein N is a positive integer.

The boost circuit 112 is coupled between the control unit 111 and a current regulation unit 130. The pulse width signal adjusting unit 115 is coupled between the control unit 111 and the current regulation unit 130. The analog dimming circuit 113 is coupled between the control unit 111 and the current regulation unit 130. A sampling analysis unit 114 is coupled to the control unit 111. The light-emitting diode strings DS1~DSN are coupled between the boost circuit 112 and the current regulation unit 130.

The boost circuit 112 is controlled by the control unit 111, for a use of outputting a driving voltage VLED to drive the light-emitting diode strings DS1~DSN inside of the light-emitting diode unit 120. The control unit 111 is for a use of determining if the duty ratio of the first pulse width modulation signal PWMI is larger than the threshold duty ratio. The sampling analysis unit 114 is for a use of receiving and analyzing the first pulse width modulation signal PWMI and outputting a pulse information signal PIS to the control unit 111, the analog dimming circuit 113, and the pulse width signal adjusting unit 115, wherein the pulse information signal PIS has a duty ratio signal and a frequency signal. The analog dimming circuit 113 is for a use of outputting the predetermined dimming current Iset corresponding to the pulse information signal PIS to the current regulation unit 130. The pulse width signal adjusting unit 115 is controlled by the control unit 111, for a use of outputting the second pulse width modulation signal PWMO corresponding to the pulse information signal PIS. Next is the instruction for relevant operation of the dimming circuit for driving the light-emitting diode unit 120.

The control unit 111 of the dimming circuit 110 controls the boost circuit 112 to supply the driving voltage VLED for driving the light-emitting diode strings DS1~DSN of the light-emitting diode unit. After receiving the first pulse width modulation signal PWMI, the control unit 111 transmits the first pulse width modulation signal PWMI to the sampling analysis unit 114, and enabling the sampling analysis unit 114 to operate a sampling and an analysis for the first pulse width modulation signal PWMI, and thus there is a relevant signal information obtained, such as a duty ratio and a frequency.

Afterwards, the sampling analysis unit 114 transmits the pulse information signal PIS to the control unit 111, the analog dimming circuit 113, and the pulse width signal adjusting unit 115, wherein the pulse information signal PIS has a duty ratio signal and a frequency signal. Later, the control unit 111 operates a calculating comparison between the duty ratio of the first pulse width modulation signal PWMI and the threshold duty ratio, and a comparing result is used in determining which dimming mechanism for the light-emitting diode unit 120 to be adopted, and to further manage the problem of the acoustic noise generated by the back-light module.

In addition, in a process of driving the light-emitting diode strings DS1~DSN, the control unit 111 receives a feedback current IF outputted by the current regulation unit 130 to adjust the driving voltage VLED, and thereby all of the light-emitting diode strings DS1~DSN of the light-emitting diode unit 120 are driven; however, it is not limited thereto.

There is more detailed instruction of two results of the comparison operated by the control unit 111 and dimming methods accordingly in the following descriptions.

When the duty ratio of the first pulse width modulation signal PWMI is smaller than the threshold duty ratio, the control unit 111 controls the analog dimming circuit 113 to output a predetermined dimming current Iset, and the control unit 111 controls the pulse width signal adjusting unit 115 to enable the frequency conversion unit 1152 inside of the width signal adjusting unit 115 to transform the first pulse width modulation signal PWMI by frequency conversion according to the received pulse information signal PIS; therefore, in the present embodiment, the frequency conversion unit 1152 increases a frequency of the first pulse width modulation signal PWMI to a frequency band of between 20 KHz~30 KHz. In an alternate embodiment, if a technique of a manufacture process supports an operation frequency of a chip to be more than 30 KHz, the frequency conversion unit 1152 increases the frequency of the first pulse width modulation signal PWMI to be equal to or more than 30 KHz; however, it is not limited thereto. Then, the phase-shift unit 1154 receives the first pulse width modulation signal PWMI transmitted by the frequency conversion unit 1152 and transforms the converted first pulse width modulation signal PWMI to a second pulse width modulation signal PWMO by a phase shift. Afterwards, the phase-shift unit 1154 transmits the second pulse width modulation signal PWMO to the current regulation unit 130 to adjust an output currents I1~IN of the light-emitting diode strings DS1~DSN.

Figure 3:
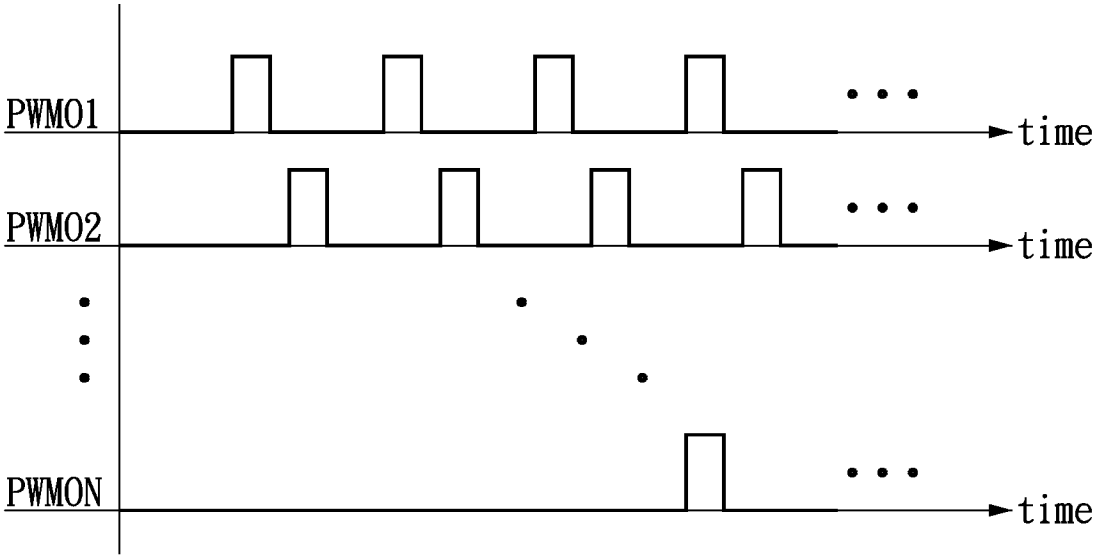
FIG. 3 shows a waveform diagram of the driven second pulse width modulation signals according to the embodiment of the instant disclosure.

For a better understanding of the later instruction, please refer to FIGS. 2 and 3 at the same time. FIG. 3 shows a waveform diagram of a performance of the driven second pulse width modulation signal according to the embodiment of the instant disclosure. The frequency conversion unit 1152 transmits the converted first pulse width modulation signal PWMI to the phase-shift unit 1154, and after the phase-shift unit 1154 receiving the converted first pulse width modulation signal PWMI, the converted first pulse width modulation signal PWMI is transformed to the second pulse width modulation signal PWMO by the phase shift; that is, there are a plurality of second pulse width modulation signals PWMO1~PWMON (as shown in FIG. 3). To be more exact, the phase-shift unit 1154 transmits second pulse width modulation signals PWMO1~PWMON to the current regulation unit 130 in order, and the output currents I1~IN of light-emitting diode strings DS1~DSN (or channels CH1~CHN) are adjusted accordingly. Thereby, the dimming circuit 110 of the present embodiment is able to lower an instant current sink, and thus a current variation and a piezoelectric effect of a capacitor are decreased, and the acoustic noise generated by the back-light module is further reduced.

It is worth mentioning that in the embodiment, please refer to FIGS. 3, the second pulse width modulation signals PWMIO~PWMON do not overlap; however, in the alternate embodiment, part of the second pulse width modulation signals PWMIO~PWMON overlap. In conclusion, there is at least a phase shift between two adjacent pulse width modulation signals, and so that the current sink of channels CH1~CHN is lowered.

When the duty ratio of the first pulse width modulation signal PWMI is larger than the threshold duty ratio, the control unit 111 controls the pulse width signal adjusting unit 115 to output a second pulse width modulation signal PWMO with 100% duty ratio (i.e. a DC voltage) to the current regulation unit 130, and the control unit 111 controls the analog dimming circuit 113. The analog dimming circuit 113 adjusts the predetermined dimming current Iset according to the received pulse information signal PIS accordingly, and transmits the adjusted predetermined dimming current Iset to the current regulation unit 130 to adjust the output currents I1~IN of light-emitting diode strings DS1~DSN inside of the light-emitting diodes. In the present embodiment, the predetermined dimming current Iset outputted by the analog dimming circuit 113 is proportional to the duty ratio of the first pulse width modulation signal PWMI; in other words, the longer working period of first pulse width modulation signal PWMI (i.e. a larger duty ratio), a value of the adjusted predetermined dimming current Iset is larger as well, and leading to higher output currents I1~IN of the light-emitting diode strings DS1~DSN.

The threshold duty ratio may be set based on the predetermined dimming current Iset; for example, the predetermined dimming current Iset is divided by a rated current of the light-emitting diode, such as 20 milliampere, to obtain a current ratio, and then the threshold duty ratio is a result of the current ratio multiplied by 100%. In addition, the rated current of the light-emitting diode is a possible highest current of a unit (the light-emitting diode) being measured after a manufacture. In an alternate embodiment, the predetermined dimming current Iset may be set as a highest light conversion efficiency of the light-emitting diode, such as 5 milliampere, and so that when the light-emitting diode unit 120 is driven under a condition of the duty ratio of the first pulse width modulation signal PWMI is smaller than the threshold duty ratio, a better driven efficiency is achieved. The highest light conversion efficiency of the light-emitting diode may be determined by a statistics result after a measurement is performed. In another alternate embodiment, the threshold duty ratio may be further determined according to a number of channel inside of the light-emitting diode unit 120; for instance, the threshold duty ratio may be multiplied by the current ratio and then be divided by the number of channel inside of the light-emitting diode unit 120, and thereby to assure that signals of the second pulse width modulation signals PWMO1~PWMON do not overlap after the conversion. In other embodiments, in addition to the number of channel inside of the light-emitting diode unit 120 is used to determine the threshold duty ratio, the threshold duty ratio may also be alternated by a random number according to a product demand.

In addition, when the duty ratio of the first pulse width modulation signal PWMI is equal to the threshold duty ratio, a designer may accord to the demand of a circuit design to define the situation as to adopt the dimming mechanism for the duty ratio of the first pulse width modulation signal PWMI larger than the threshold duty ratio, or to adopt the dimming mechanism for the duty ratio of the first pulse width modulation signal PWMI smaller than the threshold duty ratio.

In conclusion, any idea related to a concept of adjusting a predetermined dimming current and a second pulse width signal based on a duty ratio of a first pulse width signal is considered to be within the scope of the instant disclosure.

[Embodiment of a Dimming Method]

Figure 4:
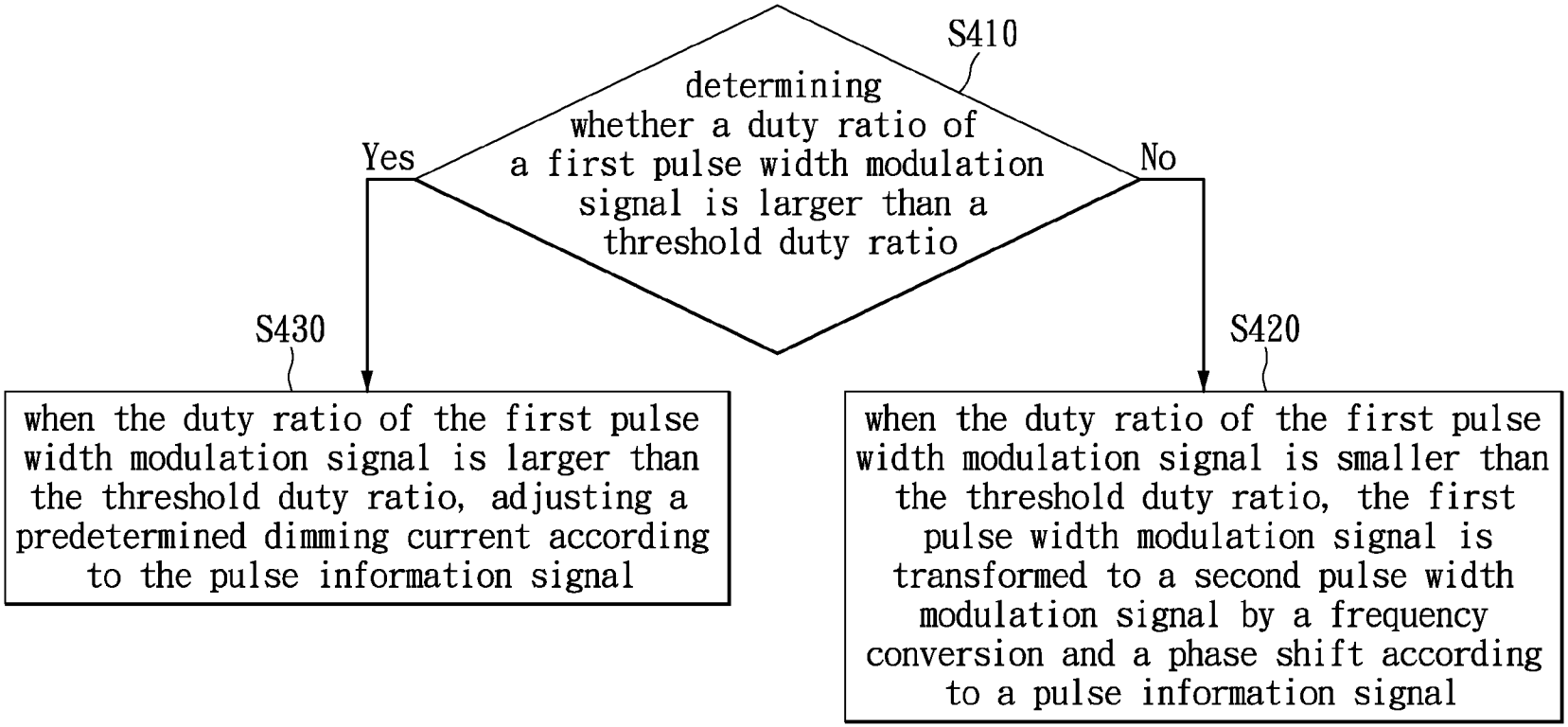
FIG. 4 shows a flow chart of a dimming method according to the embodiment of the instant disclosure.

Referring to FIG. 4, FIG. 4 shows a flow chart of a dimming method according to the embodiment of the instant disclosure. As shown in FIG. 4, steps of the dimming method are described as follows: determining whether a duty ratio of a first pulse width modulation signal is larger than a threshold duty ratio (S410); when the duty ratio of the first pulse width modulation signal is smaller than the threshold duty ratio, the first pulse width modulation signal is transformed to a second pulse width modulation signal by frequency conversion and a phase shift according to a pulse information signal (S420); when the duty ratio of the first pulse width modulation signal is larger than the threshold duty ratio, adjusting a predetermined dimming current according to the pulse information signal (S430). It is worth mentioning that the threshold duty ratio may be set based on a predetermined dimming current Iset. Details of the steps of the dimming method for the dimming circuit are recited in the above embodiments and FIGS. 1-3, and it is not repeated thereto. On the other hand, steps of the embodiments as shown in FIG. 4 are for a use of instruction; therefore, an order of the steps is not considered to be a limitation in practicing the embodiments of the instant disclosure.

To sum up, the dimming circuit and the dimming method thereof in the embodiments of the instant disclosure are to compare the duty ratio of the pulse width modulation signal with the threshold ratio, and determine which dimming mechanism to be adopted, and thus the acoustic noise is reduced, or even to completely cleared under the ideal condition. Moreover, the composite dimming method of the dimming circuit in the instant closure may be applied to the panels of various frequencies; in other words, the dimming circuit of the instant disclosure offers the composite dimming mechanism for acoustic noise reduction, and so as to save the time and cost for designing substantially.

Descriptions above are for the embodiments of the instant disclosure, and not for a limitation of scope for the instant disclosure.

The aforementioned illustrations and following detailed descriptions are exemplary for the purpose of further explaining the scope of the instant disclosure. Other objectives and advantages related to the instant disclosure will be illustrated in the subsequent descriptions and appended drawings. In the drawings, the size and relative sizes of layers and regions may be exaggerated for clarity.

It will be understood that, although the terms first, second, third, and the like, may be used herein to describe various elements, components, regions, layers and/or sections, these elements, components, regions, layers and/or sections should not be limited by these terms. These terms are only to distinguish one element, component, region, layer or section from another region, layer or section discussed below could be termed a second element, component, region, layer or section without departing from the teachings of the present disclosure. As used herein, the term "and/or" includes any and all combinations of one or more of the associated listed items.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A dimming circuit for a use of driving a light-emitting diode unit, and the dimming circuit comprising:

a control unit, receiving and determining whether a duty ratio of a first pulse width modulation signal is larger than a threshold duty ratio;

a sampling analysis unit, receiving and analyzing the first pulse width modulation signal and outputting a pulse information signal;

a pulse width signal adjusting unit coupled between the control unit and a current regulation unit to receive the pulse information signal; and an analog dimming circuit coupled between the control unit and the current regulation unit, receiving the pulse information signal, wherein when the duty ratio of the first pulse width modulation signal is smaller than the threshold duty ratio, the pulse width signal adjusting unit transforms the first pulse width modulation signal to at least a second pulse width modulation signal by a frequency conversion and a phase shift according to the pulse information signal, and the analog dimming circuit outputs a predetermined dimming current, wherein when the duty ratio of the first pulse width modulation signal is larger than the threshold duty ratio, the analog dimming circuit adjusts the predetermined dimming current according to the pulse information signal, and outputs the second pulse width modulation signal having a 100% duty ratio.

2. The dimming circuit according to claim 1, wherein the pulse width signal adjusting unit further comprising:

a frequency conversion unit, coupled to the control unit, receiving the pulse information signal and transforming the first pulse width modulation signal by frequency conversion; and a phase-shift unit, coupled between the frequency conversion unit and the current regulation unit, used for transforming the first pulse width modulation signal frequency-converted to the second pulse width modulation signal by a phase shift, and correspondingly transmitting the second pulse width modulation signal to at least one channel in order.

3. The dimming circuit according to claim 2, wherein the frequency conversion unit increases a frequency of the first pulse width modulation signal to a frequency band of between 20 KHz and 30 KHz.

4. The dimming circuit according to claim 1, wherein the pulse information signal further comprising a duty ratio signal and a frequency signal.

5. The dimming circuit according to claim 1, wherein the threshold duty ratio is set according to the predetermined dimming current and a rated current of a light-emitting diode of the light-emitting diode unit.

6. The dimming circuit according to claim 5, wherein the predetermined dimming current is a highest light conversion efficiency current.

7. The dimming circuit according to claim 5, wherein the threshold duty ratio is determined by a number of at least one channel of the light-emitting diode unit.

8. The dimming circuit according to claim 1, further comprising:

a current regulation unit, coupled between the light-emitting diode unit and the control unit, receiving the second pulse width modulation signal or the predetermined dimming current to adjust an output current of the light-emitting diode unit; and a boost circuit, coupled between the control unit and the light-emitting diode unit, controlled by the control unit to output a driving voltage and to drive the light-emitting diode unit.

9. The dimming circuit according to claim 8, wherein the light-emitting diode unit comprising:

at least one light-emitting diode string, coupled between the boost circuit and the current regulation unit, adjusting the output current by the current regulation unit.

10. A dimming method of a light-emitting diode, comprising:

determining whether a duty ratio of a first pulse width modulation signal is larger than a threshold duty ratio;

transforming the first pulse width modulation signal to at least one second pulse width modulation signal by a frequency conversion and a phase shift according to a pulse information signal and outputting a predetermined dimming current when the duty ratio of the first pulse width modulation signal is smaller than the threshold duty ratio, and adjusting the predetermined dimming current according to the pulse information signal when the duty ratio of the first pulse width modulation signal is larger than the threshold duty ratio.

11. The dimming method according to claim 10, wherein the threshold duty ratio is set according to the predetermined dimming current and a rated current of the light-emitting diode.

12. The dimming method according to claim 10, wherein the predetermined dimming current is a highest light conversion efficiency current.

13. The dimming method according to claim 10, wherein steps of transforming the first pulse information signal to the at least one second pulse width modulation signal by the frequency conversion and the phase shift according to the pulse information signal comprising:

controlling an analog dimming circuit to output the predetermined dimming current.

14. The dimming method according to claim 10, wherein steps of transforming the first pulse information signal to the at least one second pulse width modulation signal by the frequency conversion and the phase shift further comprising:

increasing a frequency of the first pulse width modulation signal to a frequency band of between 20 KHz and 30 KHz.

15. The dimming method according to claim 10, wherein steps of adjusting the predetermined dimming current according to the pulse information signal comprising:

outputting a second pulse width modulation signal having a 100% duty ratio when the duty ratio of the first pulse width modulation signal is larger than the threshold duty ratio.

16. The dimming method according to claim 10, further comprising:

outputting a driving voltage to drive a light-emitting diode unit;

receiving and analyzing the first pulse width modulation signal, and outputting the pulse information signal having a duty ratio and a frequency signal; and receiving the second pulse width modulation signal or the predetermined dimming current to adjust an output current.

* * * * *